US005415709A

United States Patent [19]

Kita

[11] Patent Number: 5,415,709

[45] Date of Patent: May 16, 1995

[54] HIGH-STRENGTH, ABRASION-RESISTANT ALUMINUM ALLOY AND METHOD FOR PROCESSING THE SAME

[75] Inventor: Kazuhiko Kita, Uozu, Japan

[73] Assignee: YKK Corporation, Tokyo, Japan

[21] Appl. No.: 163,836

[22] Filed: Dec. 7, 1993

Related U.S. Application Data

[63] Continuation of Ser. No. 920,770, Jul. 28, 1992, abandoned.

[30] Foreign Application Priority Data

Aug. 26, 1991 [JP] Japan ..... 3-213790

[51] Int. Cl.[6] ..... C22C 21/00

[52] U.S. Cl. ..... 148/437; 148/691; 148/695; 148/438; 148/439; 148/440; 420/528; 420/548; 420/550; 420/551; 420/552; 420/553

[58] Field of Search ..... 148/437, 438, 439, 440, 148/691, 695; 420/528, 550, 551, 552, 553, 548

[56] References Cited

U.S. PATENT DOCUMENTS 4,135,922 1/1979 Cebulak ..... 148/513
5,053,085 10/1991 Masumoto et al. ..... 148/437

FOREIGN PATENT DOCUMENTS 1151231 5/1969 United Kingdom .
9102100 2/1991 WIPO .

*Primary Examiner*—Upendra Roy
*Assistant Examiner*—Robert R. Koehler
*Attorney, Agent, or Firm*—Flynn, Thiel, Boutell & Tanis

[57] ABSTRACT

The present invention provides a high-strength, abrasion resistant aluminum alloy having a composition represented by the general formula $Al_aM_bX_cZ_dSi_e$, wherein M is at least one element selected from the group consisting of Fe, Co, and Ni; X is at least one element selected from the group consisting of Y, La, Ce and Mm (mischmetal); Z is at least one element selected from the group consisting of Mn, Cr, V, Ti, Mo, Zr, W, Ta and Hf; and a, b, c, d and e are all expressed by atom percent and range from 50 to 89 %, 0.5 to 10 %, 0.5 to 10 %, 0 to 10 % and 10 to 49 %, respectively, with the proviso that a+b+c+d+e =100 %, the alloy containing fine Si precipitates and fine particles of intermetallic compounds dispersed in an aluminum matrix. The aluminum alloy may further contain not greater than 5 % of at least one element selected from the group consisting of Cu, Mg, Zn and Li. The alloy can be warm-worked at 300°-500° C. and is useful for various industrial applications where high abrasion resistance and high strength are required.

4 Claims, 6 Drawing Sheets

$(Al_{0.935}Ni_{0.03}Fe_{0.01}Mm_{0.025})_{100-x}Si_x$

TEST PIECE $(Al_{0.935}Ni_{0.03}Fe_{0.01}Mm_{0.025})_{100-x}Si_x$

HIGH-STRENGTH, ABRASION-RESISTANT ALUMINUM ALLOY AND METHOD FOR PROCESSING THE SAME

This application is a continuation of U.S. Ser. No. 07/920 770, filed Jul. 28, 1992, now abandoned.

BACKGROUND OF THE INVENTION

1. Field of the Invention

This invention relates to a high-strength, abrasion resistant aluminum alloy usable for sliding members, especially for vanes and rotors of rotary compressors, valve operating mechanisms of internal combustion engines, cylinders of magnetic heads, cylinders and pistons of miniature engines of model assemblies, pistons of engines and the like, and also to a method for processing the aluminum alloy.

2. Description of the Prior Art

In many instances, cast iron or alloyed steel is employed as a counterpart material for the sliding members described above so that the sliding members are used in combination with such a counterpart material.

The material employed for these members is, therefore, required to have excellent strength and heat resistance together with high abrasion resistance and also a coefficient of thermal expansion not too much different from the coefficient of thermal expansion of the counterpart material.

Among conventional aluminum alloys, Al—Si alloys are known as having excellent abrasion resistance. Among them, those having an Si content of 12–25 wt % are widely employed. Many of these materials are cast materials and, in order to exhibit abrasion resistance by coarse primary silicon crystals, coarse Si crystals of 20 μm or greater are precipitated in the alloys.

The above-described cast Al—Si alloys are, however, accompanied by the problems that their sliding counterpart materials are subjected to more wearing by coarse primary silicon crystals and that they have low strength because they are cast materials. Further, processing operations are difficult—including cutting, cold working and warm working.

To improve the processability, it is necessary to reduce the Si content. A reduction in the Si content, however, leads to a greater coefficient of thermal expansion, resulting in the problem that difficulties are encountered in securing a suitable clearance relative to the sliding counterpart material.

SUMMARY OF THE INVENTION

The present invention has overcome the above problems. In one aspect of this invention, there is thus provided a high-strength, abrasion-resistant aluminum alloy having a composition represented by the general formula: $Al_aM_bX_cZ_dSi_e$ wherein M is at least one element selected from the group consisting of Fe, Co and Ni; X is at least one element selected from the group consisting of Y, La, Ce and Mm (mischmetal); Z is at least one element selected from the group consisting of Mn, Cr, V, Ti, Mo, Zr, W, Ta and Hf; and a, b, c, d and e are all expressed by atom percent and range from 50 to 89%, 0.5 to 10%, 0.5 to 10%, 0 to 10% and 10 and 49%, respectively, with the proviso that $a+b+c+d+e=100\%$, said alloy containing fine Si precipitates in an aluminum matrix and finely dispersed particles of intermetallic compounds in the aluminum matrix. The aluminum alloy may additionally contain not greater than 5% of at least one element selected from the group consisting of Cu, Mg, Zn and Li.

In a second aspect of this invention, there is also provided the warm-working of the aluminum alloy of the above composition at 300°–500° C. into various members.

DETAILED DESCRIPTION OF THE PREFERRED EMBODIMENTS

Figure 1:
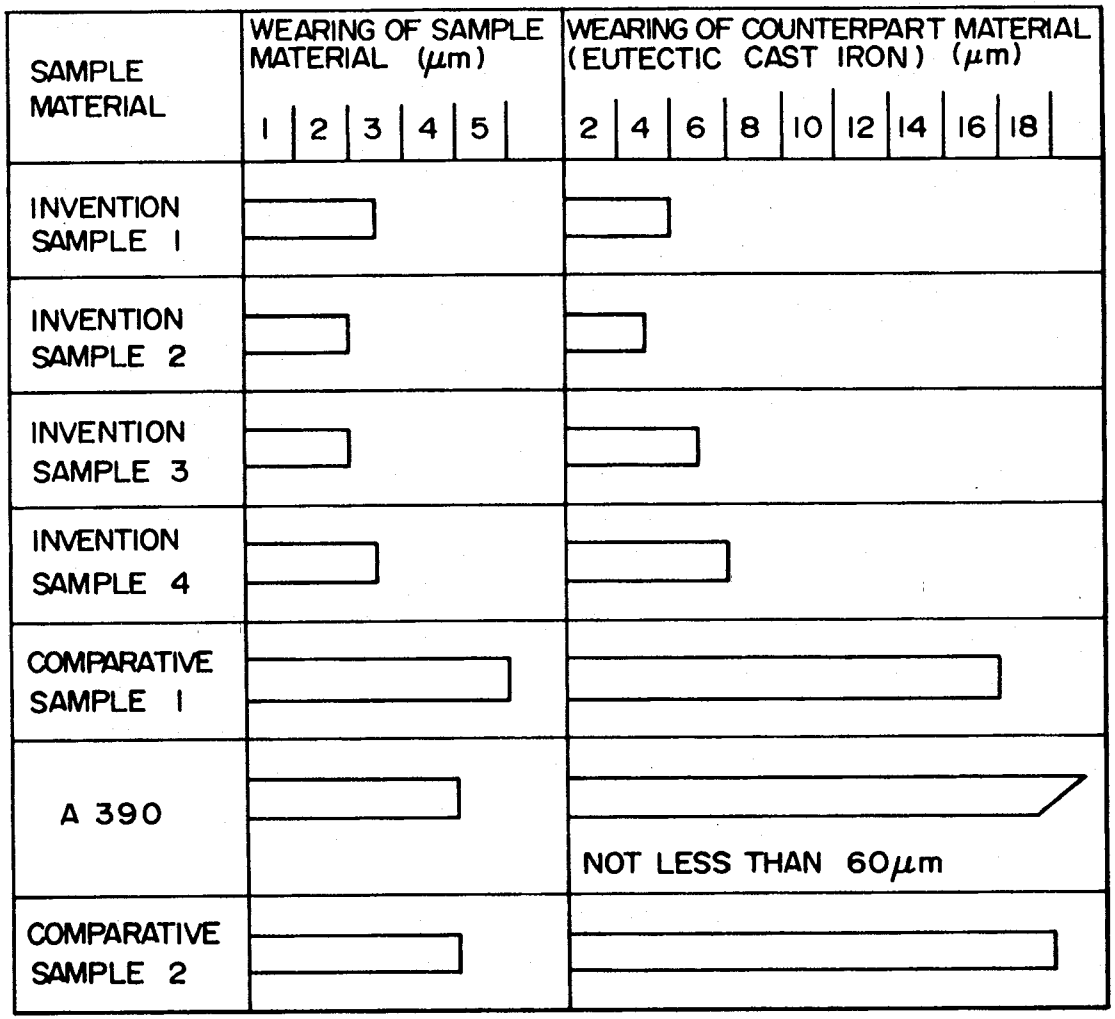
FIG. 1 is a graph diagrammatically showing the results of a test on the extents of wearing of sample materials and those of their counterpart materials.

In the composition of the present invention, is not preferred to reduce the content of Al to less than 50% from the significance of weight reduction. Al contents greater than 89% are not preferred because the strength and abrasion resistance are reduced.

Fe, Co and/or Ni as the element M forms intermetallic compounds with Al and is dispersed as fine particles of 0.01–5 μm or so in the aluminum matrix to enhance the strength and heat resistance. If its content exceeds 10%, dispersed particles become so plentiful that embrittlement takes place. If its content is less than 0.5%, the matrix cannot be strengthened sufficiently.

Y, La, Ce and/or Mm as the element X also forms intermetallic compounds with Al and is dispersed as fine particles of 0.01–5 μm or so to enhance the strength and heat resistance. If its content exceeds 10%, dispersed particles become so plentiful that embrittlement takes place. If its content is less than 0.5%, the matrix cannot be strengthened sufficiently.

Mn, Cr, V, Ti, Mo, Zr, W, Ta and/or Hf as the element Z forms a solid solution with Al to enhance the Al matrix and, at the same time, form intermetallic compounds with Al or by itself and is dispersed as fine particles of 0.1 μm or smaller in crystalline grains of Al, thereby reducing the coarsening of crystal grains and enhancing the strength and heat resistance. If its content exceeds 10%, dispersed particles become so plentiful that embrittlement takes place. Although no particular limitation is imposed on the lower limit of the content of the element Z, the content of the element Z may be preferably at least 0.5% from the viewpoint of enhancement of the matrix.

Si itself is dispersed as fine particles of 10 μm or smaller, thereby serving to enhance the abrasion resistance and hardness of the alloy. By adjusting the amount (content) of Si particles to be dispersed, the coefficient of thermal expansion of the alloy can be controlled. Amounts smaller than 10% are not effective for the improvement of abrasion resistance, whereas amounts in excess of 49% make materials brittle so that their strength is reduced.

The alloy according to the present invention can be obtained as powder prepared by conducting quenching at a solidification rate of $10^{4°}$ C./sec or higher in accordance with an atomizing process or as a quenched thin ribbon prepared by conducting quenching in a similar manner. The thus obtained atomized powder is a powder metallurgical raw material having good processability. The quenched ribbon is cut as it is and is used as sliding members.

The material in the above-described form is subjected to processing such as pressing or extrusion and is then finish-processed into a final product. These processings are conducted in a warm range of from 300° C. to 500° C. This temperature range can provide the product with practical strength. As a specific extrusion process, atomized powder is filled under vacuum within an aluminum can and is then extruded at a temperature of 350°±30° C. under a pressing force of 10 tons/cm$^2$. The thus-processed material has a structure such that fine Si particles, preferably of 0.1–5 μm, and fine particles of intermetallic compounds, preferably of 0.01–5 μm, are evenly dispersed in an Al-supersaturated solid solution formed upon atomization.

In the alloy according to the present invention, the abrasion resistance of the aluminum alloy has been enhanced primarily by the precipitated Si and the intermetallic compounds. Because Si precipitates are very small, they do not affect the processability and, when employed as a sliding member, do not cause the counterpart material to wear, even if the Si content is increased. Further, the heat resistance and strength have been enhanced by the intermetallic compounds and the heat resistance has been enhanced by the solid solution or the like of the element Z, so that the structure of the alloy is not as coarse even when subjected to warm working.

The present invention will hereinafter be described by the following Examples.

EXAMPLE 1

Materials of the compositions shown under the invention samples in Table 1 and under the comparative samples in Table 2, respectively, were subjected to high-frequency melting, whereby master alloys were produced. Those master alloys were separately formed into quench-solidified thin ribbons (thickness: 0.02 mm, width: 1 mm) by a single roll and then subjected to X-ray diffraction. They were found to have the structures and hardnesses presented in Table 3 and Table 4, in which "FCC" indicates a face centered cubic crystalline structure.

TABLE 1

| Invention Sample No. | Composition (at. %) | | | | | |
|---|---|---|---|---|---|---|
| | Al | Si | M | X | Zr | Others |
| 1 | Balance | 12 | Fe = 1.0 | Y = 5.0 | | Cu = 0.3 |
| 2 | Balance | 15 | Ni = 8.0 | Mm = 2.5 | Zr = 0.5 | |
| 3 | Balance | 15 | Ni = 5.0, Co = 4.0 | La = 1.0 | Mn = 1.0 | Mg = 1.0 |
| 4 | Balance | 20 | Fe = 3.0 | Ce = 7.0 | Li = 4.0 | |
| 5 | Balance | 20 | Ni = 3.5, Fe = 1.0 | Ce = 2.0 | | |
| 6 | Balance | 20 | Ni = 4.0, Fe = 1.0 | Mm = 2.0 | | |
| 7 | Balance | 25 | Co = 2.0 | Y = 3.0 | W = 3.0 | |
| 8 | Balance | 25 | Fe = 4.0 | Mm = 1.0 | Mo = 1.0, V = 1.5 | Zn = 3.0 |
| 9 | Balance | 25 | Fe = 1.0 | Y = 2.5 | Ta = 3.0 | |
| 10 | Balance | 30 | Co = 7.0 | Ce = 0.6 | Cr = 2.0 | Cu = 1.0 |
| 11 | Balance | 30 | Fe = 0.6 | Mm = 2.0 | Ti = 1.0 | Mg = 3.0 |
| 12 | Balance | 35 | Fe = 1.2 | Mm = 2.1 | Zr = 8.0 | |
| 13 | Balance | 35 | Ni = 3.0 | Ce = 3.0 | Zr = 4.0 | |
| 14 | Balance | 40 | Ni = 2.0 | Mm = 2.5 | | |
| 15 | Balance | 40 | Fe = 0.6, Ni = 1.2 | Mm = 1.0 | Ti = 1.2 | Mg = 2.0 |
| 16 | Balance | 45 | Fe = 1.2 | Y = 3.0 | | |

TABLE 2

| Comparative Sample No. | Composition (at. %) | | | | | |
|---|---|---|---|---|---|---|
| | Al | Si | M | X | Z | Others |
| 1 | Balance | 5 | Fe = 3.0 | Ce = 0.9 | | |
| 2 | Balance | 20 | | | | Cu = 3.0 |
| 3 | Balance | 20 | | | | Mg = 1.0 |
| 4 | Balance | 40 | | | Cr = 3.0 | |
| 5 | Balance | 30 | Fe = 3.0 | | | |
| 6 | Balance | 5 | | Mm = 1.0 | Cr = 1 | |

TABLE 3

| Invention Sample No. | Structure | Hardness (Hv) |
|---|---|---|
| 1 | FCC + Si + intermetallic compound | 200 |
| 2 | FCC + Si + intermetallic compound | 230 |
| 3 | FCC + Si + intermetallic compound | 235 |
| 4 | FCC + Si + intermetallic compound | 250 |
| 5 | FCC + Si + intermetallic compound | 270 |
| 6 | FCC + Si + intermetallic compound | 285 |
| 7 | FCC + Si + intermetallic compound | 300 |
| 8 | FCC + Si + intermetallic compound | 350 |
| 9 | FCC + Si + intermetallic compound | 360 |
| 10 | FCC + Si + intermetallic compound | 365 |
| 11 | FCC + Si + intermetallic compound | 350 |
| 12 | FCC + Si + intermetallic compound | 370 |
| 13 | FCC + Si + intermetallic compound | 340 |
| 14 | FCC + Si + intermetallic compound | 375 |
| 15 | FCC + Si + intermetallic compound | 330 |
| 16 | FCC + Si + intermetallic compound | 320 |

TABLE 4

| Comparative Sample No. | Structure | Hardness (Hv) |
|---|---|---|
| 1 | FCC | 130 |
| 2 | FCC | 100 |
| 3 | FCC | 80 |
| 4 | FCC + Si | 75 |
| 5 | FCC + Si | 90 |
| 6 | FCC | 55 |

The hardness of each sample is a value (DPN) as measured by a Vickers microhardness tester under 25 g load. It is understood that the materials according to the present invention had a hardness (Hv) of 200–375 and were extremely hard whereas the comparative materials had a hardness of 55–130 and were inferior to the invention materials.

EXAMPLE 2

Invention Samples 1, 2, 3 and 4 in Table 1, Comparative Samples 1 and 2 in Table 2 as well as an alloy having a composition equivalent to A390 (designation by Japanese Industrial Standards) were each formed into powder (average particle size: 15 μm) by the high-pressure gas atomizing method. After they were confirmed to have the same structures as those of the corresponding Samples shown in Table 3 and Table 4, they were separately filled in copper containers, capped, evacuated to $1\times10^{-5}$ Torr, and then compressed at 347° C. by a press into billets.

Each billet was separately placed in a container of an extruder and warm-extruded at 377° C. and an extrusion ratio of 10, whereby an extruded rod was obtained. The extruded rods prepared from the invention samples had the structure that intermetallic compounds and Si were evenly distributed as fine particles. On the other hand, the extruded rods prepared from the comparative samples had an FCC structure.

Figure 2:
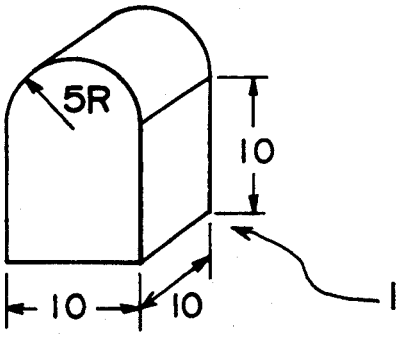
FIG. 2 is a schematic illustration of the shape of each abrasion test piece.
Figure 3:
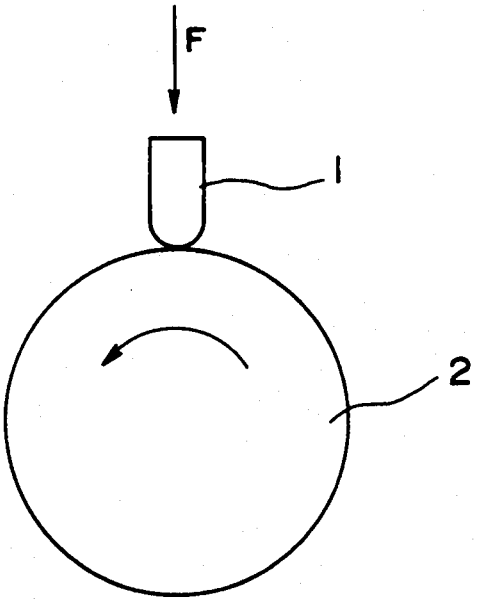
FIG. 3 is a schematic illustration of an abrasion testing method.

The above extruded material was worked into a configuration as shown in FIG. 2, disposed in contact with a rotor made of eutectic cast iron, as a counterpart material as shown in FIG. 3, and then tested under the following conditions: load "F": 100 kg/mm, velocity: 1 m/sec, lubricating oil: "REFOIL NS-4GS" (trade name; product of Nippon Oil Company, Ltd.). In FIG. 2, reference numeral 1 shows a test piece and all dimensions are shown in millimeter units. Reference numerals 1 and 2 in FIG. 3 show the test, piece and the rotor, respectively. The results are diagrammatically shown in FIG. 1.

The alloy having the composition equivalent to A390 aluminum alloy, known as an abrasion-resistant aluminum alloy, and Comparative Samples 1 and 2 caused the counterpart materials to wear substantially. In the case of the samples of the present invention, they and the counterpart materials were both worn less so that the materials according to this invention were found to have good compatibility with the counterpart materials.

EXAMPLE 3

Figure 4:
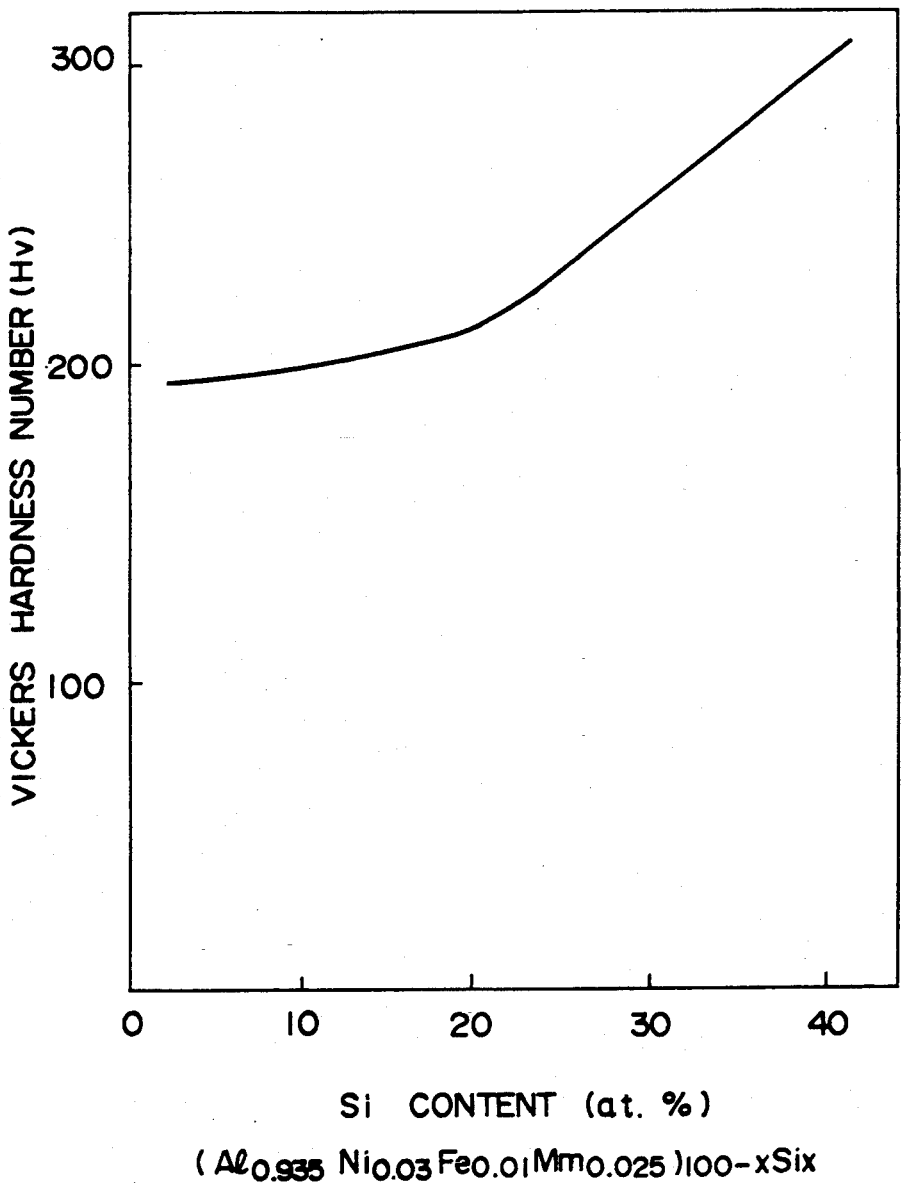
FIG. 4 is a graph showing a relationship between Si content and hardness in Example 3.
Figure 5:
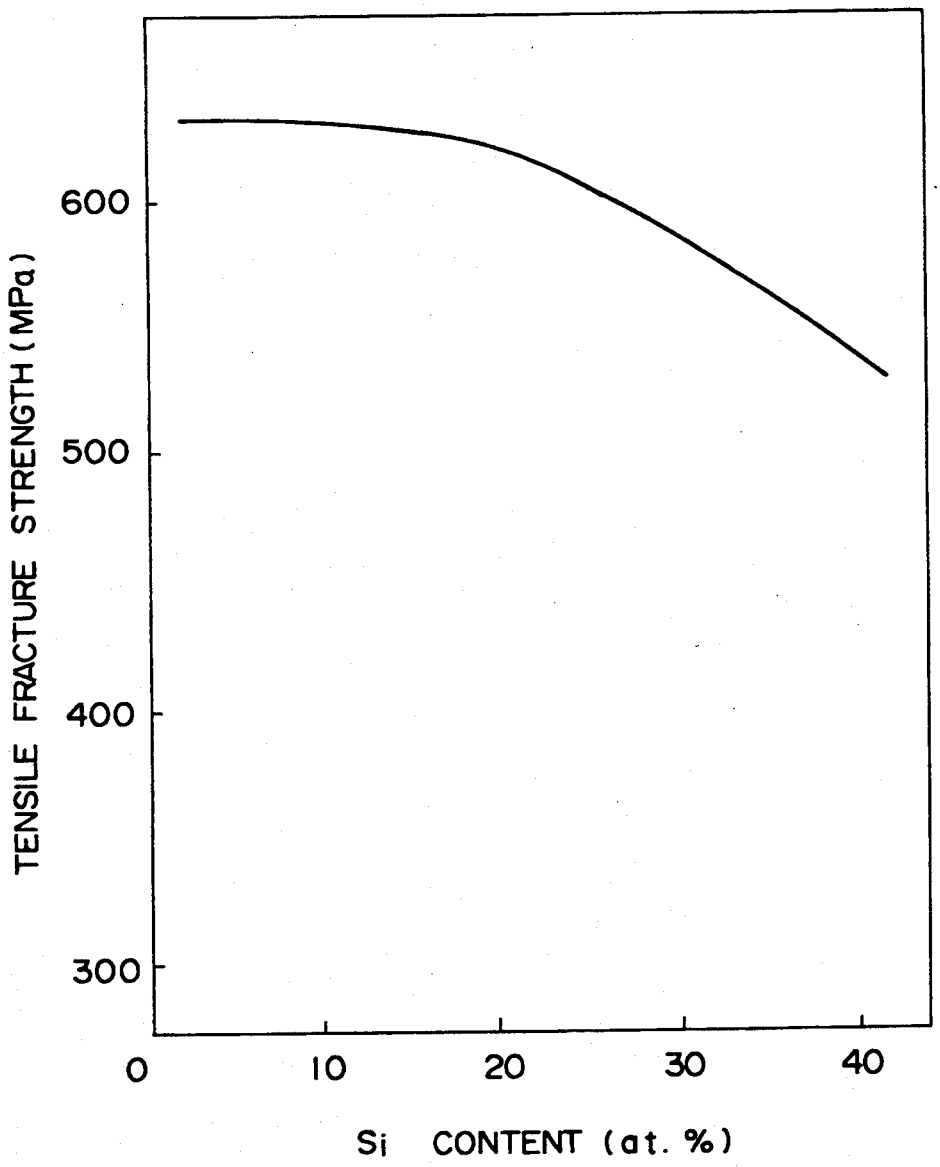
FIG. 5 is a graph showing a relationship between Si content and tensile fracture strength in Example 3.
Figure 6:
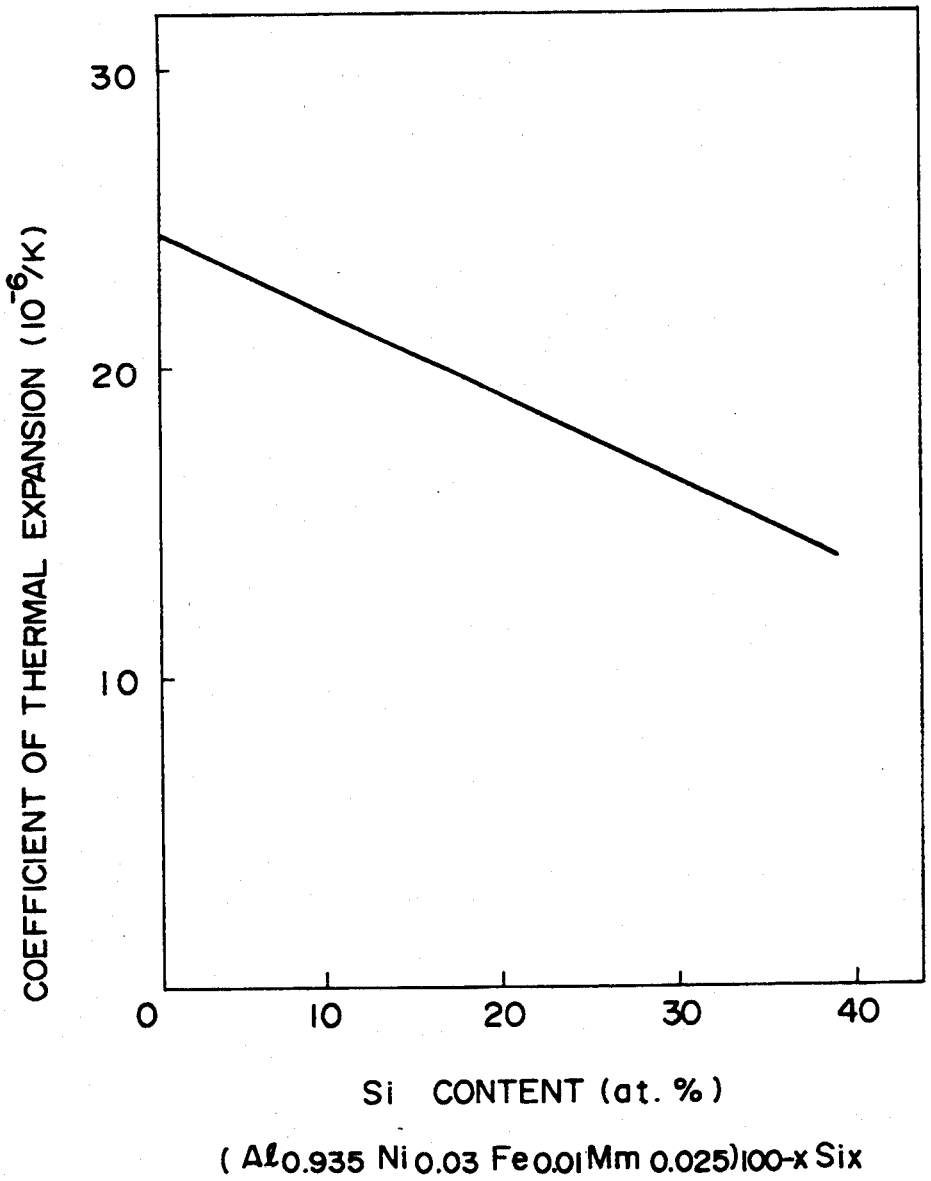
FIG. 6 is a graph showing a relationship between Si content and coefficient of thermal expansion in Example 3.

By changing the Si content of an alloy having the composition of $(Al_{0.935}Ni_{0.03}Fe_{0.01}Mm_{0.02})100\text{-}_xSi_x$ in a similar manner to Example 2, variations in hardness (Hv), tensile fracture strength (MPa) and coefficient of thermal expansion ($10^{-6}$/K) were investigated. The results are diagrammatically shown in FIG. 4, FIG. 5 and FIG. 6, respectively. It is envisaged that the processability is not affected even when the Si content is increased, and also that the coefficient of thermal expansion can be controlled as desired by adjusting the Si content.

EXAMPLE 4

Figure 7:
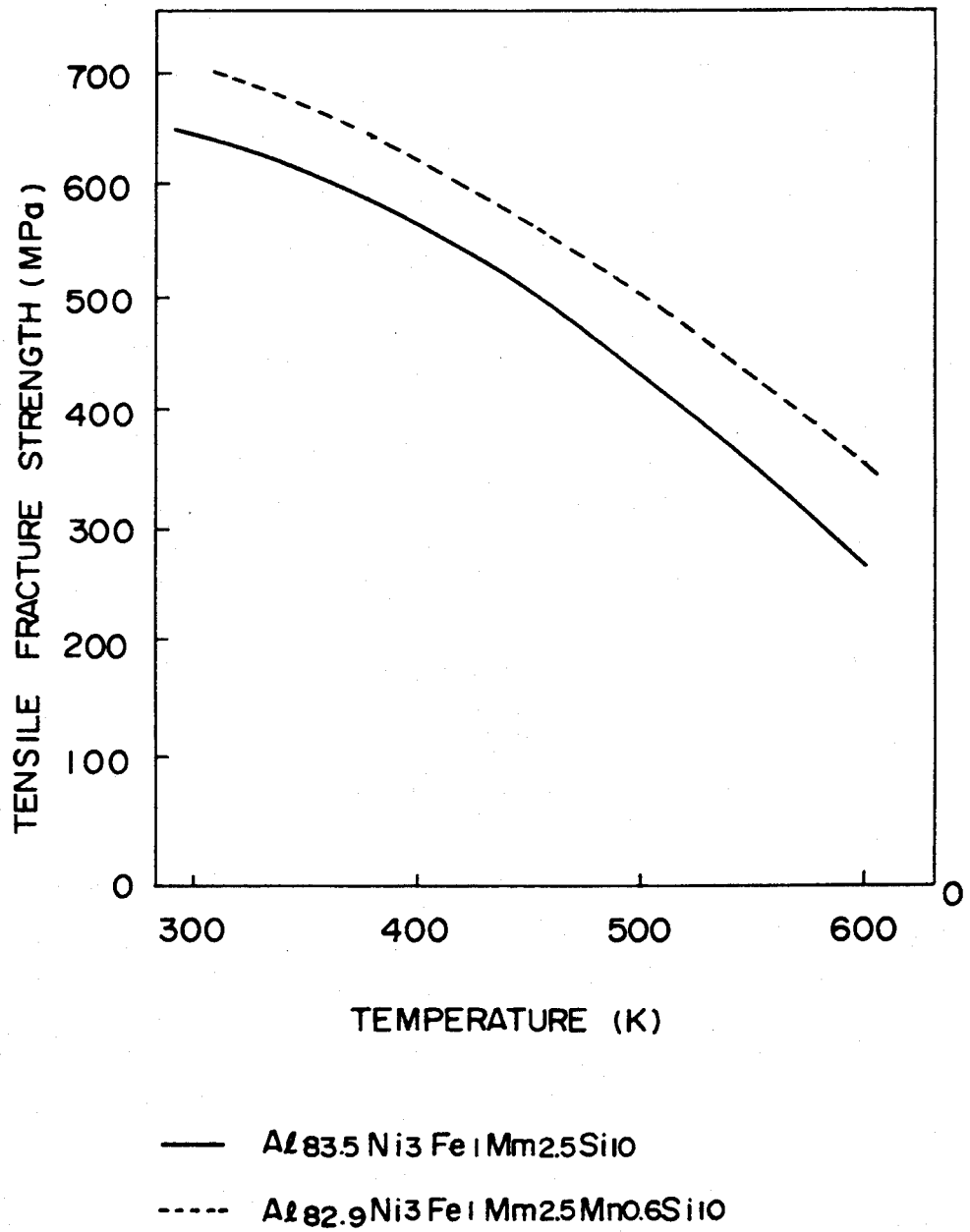
FIG. 7 is a graph showing a relationship between temperature and tensile fracture strength in Example 4.

Measurement results of temperature dependency of tensile fracture strength (MPa) are diagrammatically illustrated in FIG. 7, with respect to $Al_{83.5}Ni_3Fe_1Mm_{2.5}Si_{10}$ (solid curve) and $Al_{82.9}Ni_3Fe_1Mm_{2.5}Mn_{0.6}Si_{10}$ (dotted curve). From the results, it is understood that abrasion-resistant materials having high heat resistance were obtained.

In the alloy according to this invention, the abrasion resistance has been enhanced primarily by finely precipitated Si particles and intermetallic compound particles. The processability of the alloy is not affected, even when the content of Si is increased, whereby warm working is feasible. Even when being subjected to warm working, its crystalline structure undergoes little coarsening. Further, the heat resistance and strength have been enhanced by the intermetallic compounds.

Its coefficient of thermal expansion can be controlled depending on the content of Si. When the alloy of this invention is used as a sliding member, its coefficient of thermal expansion can be easily brought into conformity with that of a counterpart material.

What is claimed is:

1. A high-strength, abrasion-resistant aluminum alloy having a composition represented by the general formula $Al_aM_bX_cZ_dSi_e$, wherein M is at least one element selected from the group consisting-of Fe, Co, and Ni; X is at least one element selected from the group consisting of Y, La, Ce and Mm (mischmetal); Z is at least one element selected from the group consisting of Mn, Cr, V, Ti, Mo, Zr, W, Ta and Hf; and a, b, c, d and e are all expressed by atom percent and range from 50 to 89%, 0.5 to 10%, 0.5 to 10%, 0 to 10% and 10 and 49%, respectively, with the proviso that $a+b+c+d+e=100$ at %, said alloy containing fine Si precipitates having a particle size of from 0.1 to 5 μm in an aluminum matrix and finely dispersed particles of intermetallic compounds having a particle size of from 0.01 to 5 μm dispersed in the aluminum matrix.

2. An alloy as claimed in claim 1, wherein said alloy further contains not greater than 5 at % of at least one element selected from the group consisting of Cu, Mg, Zn and Li, based on 100 at % of said composition.

3. A method for processing a high-strength, abrasion-resistant aluminum alloy, which comprises warm-working at 300°–500° C. an aluminum alloy stock having a composition represented by the general formula $Al_aM_bX_cZ_dSi_e$, wherein M is at least one element selected from the group consisting of Fe, Co and Ni; X is at least one element selected from Y, La, Ce and Mm (mischmetal); Z is at least one element selected from the group consisting of Mn, Cr, V, Ti, Mo, Zr, W, Ta and Hf; and a, b, c, d and e are all expressed by atom percent and range from 50 to 89%, 0.5 to 10%, 0.5 to 10%, 0 to 10% and 10 and 49% respectively, with the proviso that $a+b+c+d+e=100$ at %, said alloy containing fine Si precipitates having a particle size of from 0.1 to 5 μm in an aluminum matrix and finely dispersed particles of intermetallic compounds having a particle size of from 0.01 to 5 μm dispersed in the aluminum matrix.

4. A process as claimed in claim 3, wherein said composition further contains not greater than 5 at % of at least one element selected from the group consisting of Cu, Mg, Zn and Li, based on 100 at % of said composition.

* * * * *